United States Patent [19]

Helmer

[11] Patent Number: 4,573,586

[45] Date of Patent: Mar. 4, 1986

[54] EASTER EGG DYEING AND DRYING DEVICE

[76] Inventor: Michael T. Helmer, 7517 Blackthorne Way, Citrus Heights, Calif. 95610

[21] Appl. No.: 490,324

[22] Filed: May 2, 1983

[51] Int. Cl.[4] ..... A47F 7/00

[52] U.S. Cl. ..... 211/14; 248/346; 211/74

[58] Field of Search ..... 211/14, 71, 74, 60 R, 211/69.5, 69.2, 69.4, 69, 70.6; 248/346, 542

[56] References Cited

U.S. PATENT DOCUMENTS

| | | | |
|---|---|---|---|
| 102,398 | 4/1870 | Hibbs | 211/74 X |
| 697,247 | 4/1902 | Harris | 211/74 X |
| 1,771,589 | 7/1930 | Strauss | 248/346 |
| 1,982,723 | 12/1934 | Bantleon et al. | 248/346 |
| 3,102,706 | 9/1963 | Goldsmith | 248/542 |

FOREIGN PATENT DOCUMENTS

| | | | |
|---|---|---|---|
| 763956 | 5/1934 | France | 211/14 |
| 983225 | 6/1951 | France | 211/14 |
| 1116157 | 6/1968 | United Kingdom | 211/60 R |

*Primary Examiner*—Ramon S. Britts
*Assistant Examiner*—Sarah A. Lechok Eley
*Attorney, Agent, or Firm*—Mark C. Jacobs

[57] ABSTRACT

A free standing metal or plastic device featuring a plurality of spaced wells for either receiving dye cup inserts or for serving directly as dye holding compartments, and a plurality of spaced egg receiving drying compartments. The unit incorporates means to contain accidental spillage of dye.

Preferably the structure should be oval shaped horizontal configuration in keeping with the egg theme.

11 Claims, 13 Drawing Figures

EASTER EGG DYEING AND DRYING DEVICE

BACKGROUND OF THE INVENTION

Each year hundreds of thousands of kids in the United States and other countries participate in Easter egg dyeing festivities. While the kids love it, the parents or teachers hate it, because egg dyeing is a messy art. The children, usually of age 3 to 11, spill the dye on the table or on themselves.

In addition, few people have proper storage facilities for temporary storage of the eggs while the dye dries on the surface of the shell of the egg. Shot glasses are often employed for this purpose, usually to the dismay of mom who is worries about the fate of her good crystal.

Yet another problem experienced by egg dyers, is the chore of making sure that all of the dye is washed out of the family cereal bowls or other dishes used for dyeing. On the other hand if old tin cans are used for dye holders, care must be exercised to prevent cut fingers and palms from the can edges, while glass bottles are always susceptible to being knocked to the ground and broken.

It is seen, therefore, that there is indeed a need for a device which is low cost, can easily be used by kids without the concern for breakage, and which is strictly dedicated to the fine art of dyeing and drying Easter eggs.

It is an object therefore of this invention to provide a device suitable for receiving egg dye therein or optionally for receiving dyeing cups which in turn will hold the dye for Easter eggs.

It is another object of this invention to provide a device which will permit the just dyed eggs to be stored temporarily while the dye dries thereon.

Another object is to provide a device that is easy to manufacture and low in cost suitable for Easter egg dyeing.

It is another object of this invention to provide therein means to contain accidental drips and spills during the dyeing and drying of Easter eggs.

Yet another object is to provide a device that is egg shaped for the dyeing of Easter eggs.

Other objects of the invention will in part be obvious and will in part appear hereinafter.

The invention accordingly comprises the product possessing the features, properties and the relation of the components which are exemplified in the following detailed disclosure, and the scope of which will be indicated in the claims.

For a fuller understanding of the nature and objects of the invention, reference should be had to the following detailed description taken in conjunction with the accompanying drawings.

SUMMARY OF THE INVENTION

The Easter egg dyeing and drying rack or tray of this invention is a one piece metal or plastic structure, preferably of egg shaped configuration for its horizontal cross section, having a first upper elevation and a second lower elevation. The first elevation includes a plurality of wells which themselves can hold egg dye, or which can receive dye cups which in turn hold dye. The lower elevation includes a series of spaced apart circumscribing recesses adapted to hold an egg partway therein for drying of the coated dye. A series of ridges and valleys for the containment of drips and spills are incorporated into the structure of this apparatus.

DESCRIPTION OF THE PREFERRED EMBODIMENT

Figure 1:
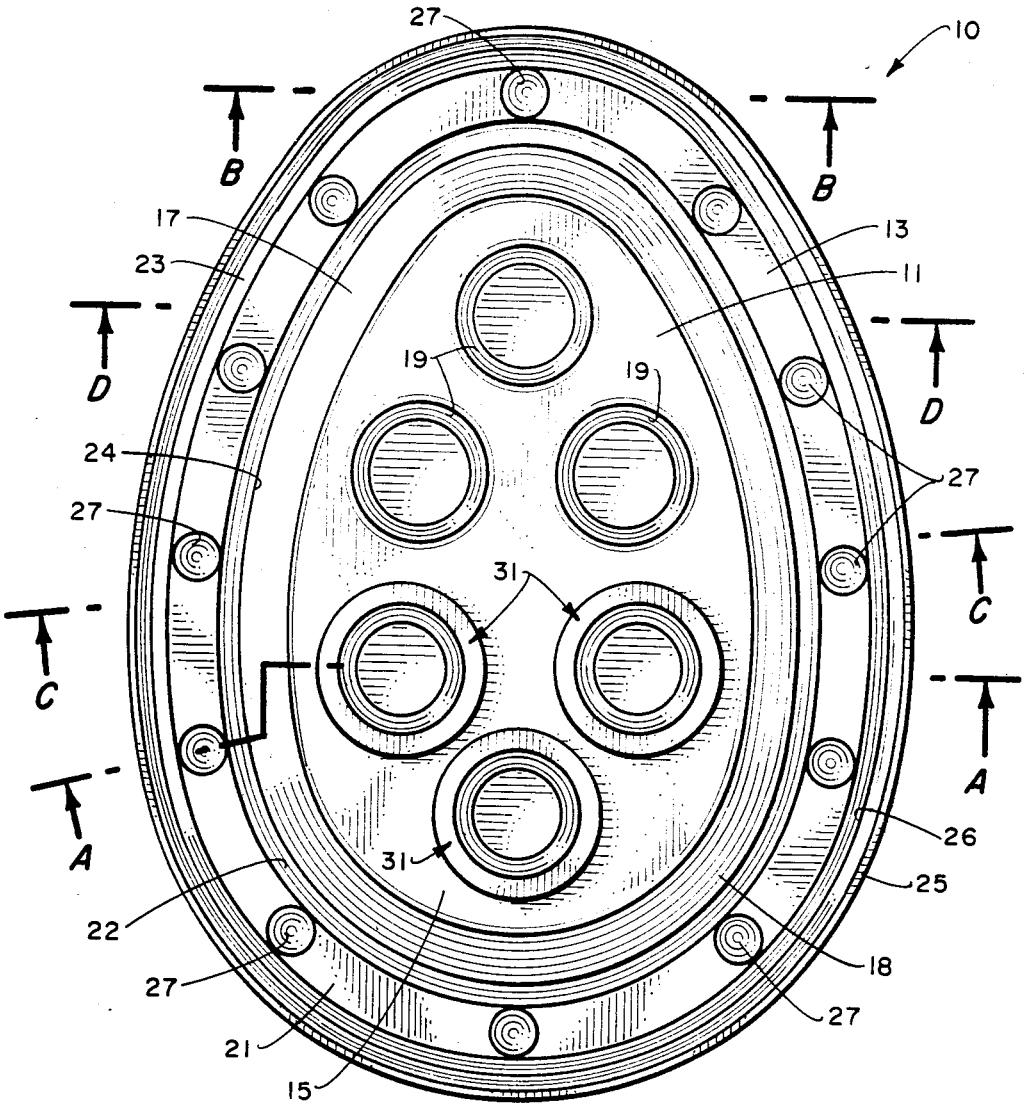
FIG. 1 is a top plan view of the device of this invention shown with three (3) dye wells.

Turning now to the figures, there is shown in FIG. 1 a top plan view of the preferred configuration of the instant device. It is shown as being oval or egg shaped, in view of the intended use. The device obviously could be configured rectangularly as well if such was desired.

The device of the instant invention 10 comprises a one piece structure having an upper portion 11 and a lower portion 13. The upper portion 11 includes a top surface 15 and a continuous downwardly and outwardly depending side wall 17. Lower portion 13 surrounds upper portion 11. The lower portion top surface 21 is disposed at an elevation approximately ⅓ up from the bottom of the side wall 17 of the top portion. This is readily seen in FIGS. 2, 4, 5, 7 & 8.

The lower section of side wall 17, designated 18, and its opposed neighbor, lower portion inside wall 22 taken together form a dye trap 24 to catch any dye that spills over from the wells or dye cups of the upper portion. This trap is shown by the dotted line area of FIG. 10.

The lower portion 13 includes top surface 21, lower inside wall 22 and lower outside wall 23. Both of walls 22 and 23 are seen to be downwardly and outwardly depending. Though this is for ease of manufacturing, it is preferred that these walls be angled as they contribute to the formation of trap 24 and edge trap 26, the former to catch excess dye during the coloring step, the latter to catch excess runoff during the drying step. Edge trap 26 is formed by upstanding flange 25 and the lower section of the side wall 23.

The top portion 11 includes a plurality of suitably spaced dye wells 19, while the lower portion 13 includes a series of recesses 27 for holding eggs. Both of these will be discussed in detail below.

Figure 6:
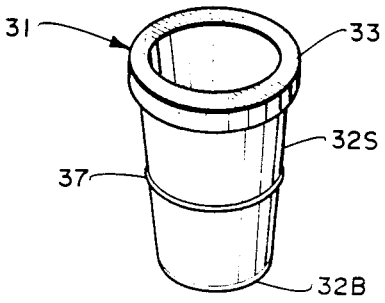
FIG. 6 is a perspective view of one portion of this invention.
Figure 10:
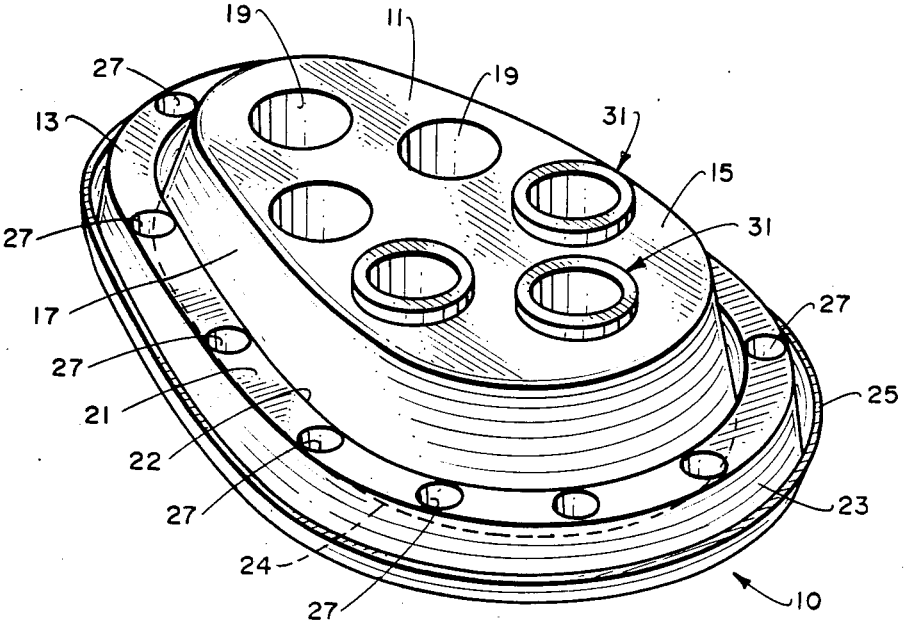
FIG. 10 is a perspective view of the invention.

The top portion 11 may be configured with its top surface as shown in FIG. 10 where the top is smooth and even, and a plurality of dye cups 31, seen in FIG. 6 are employed. A cross-section of this type of configuration is shown in FIG. 2.

Turning momentarily to FIG. 6, a typical dye cup 31 employable in this invention is seen. It resembles in configuration a standard flower pot, in that it includes a downwardly depending continuous side wall 32S and a horizontal bottom wall 32B. At the top of the side wall is an outwardly depending circumscribing flange 33. Dye cup 31 is sized such that it is adapted to be readily insertable into dye well 19, whereby flange 33 rests on the top surface 15 of the device 10. These dye wells may be made of plastic such as polyethylene or styrene or ABS plastics among others, as well as metal such as aluminum or galvanized or coated steel. Reference is made to FIG. 2 which shows two dye cups disposed within wells 19 or 20.

Figure 3:
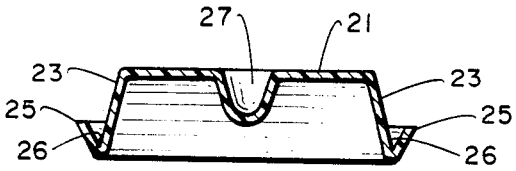
FIG. 3 is a sectional view along line B—B of FIG. 1.
Figure 4:
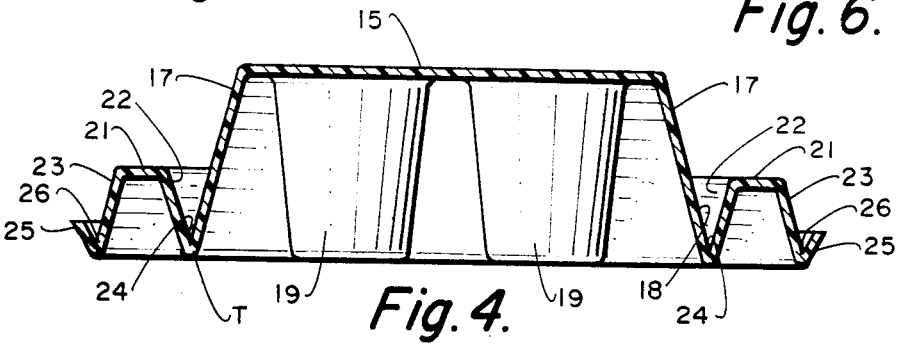
FIG. 4 is a sectional view along line C—C of FIG. 1.
Figure 5:
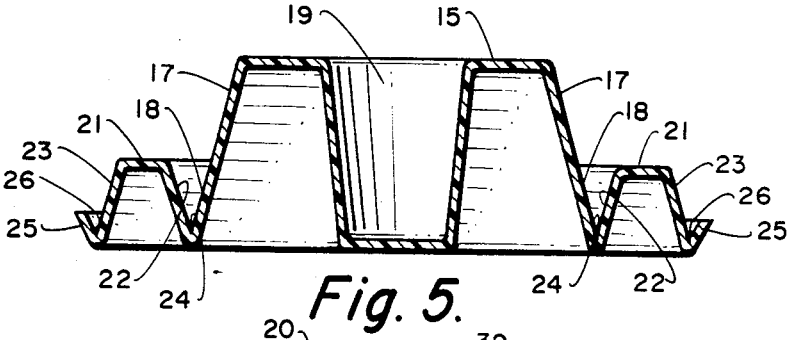
FIG. 5 is a sectional view along line D—D of FIG. 1.

FIGS. 3, 4, and 5 are sectional views along several cuts as noted previously in FIG. 1. Since all parts or elements seen in these figures have been discussed previously, further discussion of these figures is not necessary. Suffice it to say that designator T depicts the thickness or gauge of material used for the construction of the instant device. It is within the skill of the routine metal worker to determine what would be a suitable thickness for the metal or plastic to be used in the manufacture of the instant product.

Figure 2:
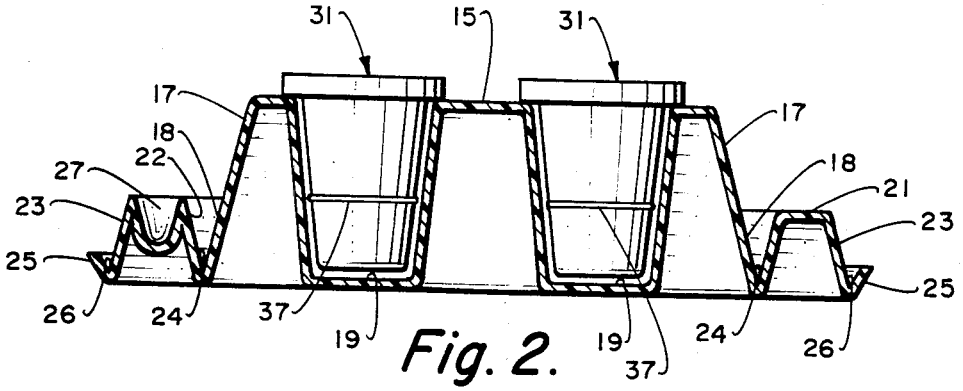
FIG. 2 is a sectional view taken along the line A—A of FIG. 1.
Figure 7:
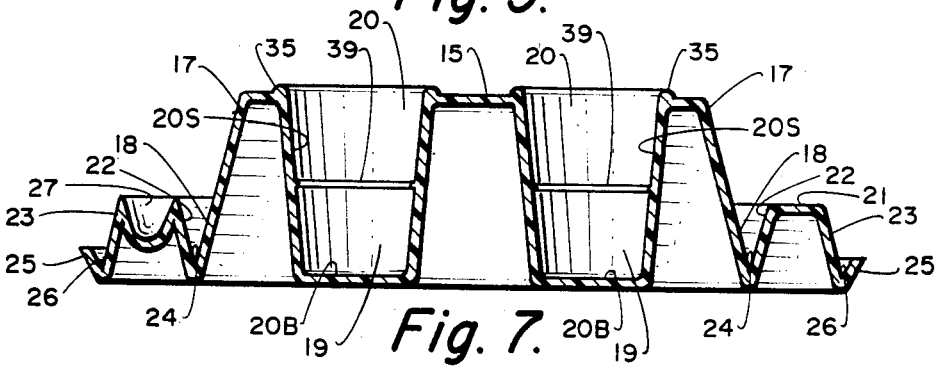
FIG. 7 is a sectional view of a variant form of the invention as if taken along line A—A of FIG. 1.

Just as the embodiment of FIG. 2 includes two portions, an upper and a lower, and just as the embodiment of FIG. 2 has a plurality of spaced dye wells, and a plurality of circumscribing egg receiving recesses 27 in the lower portion, so, too, does the embodiment of FIG. 7.

Here however, the top surface 15 rather than being flat in toto, includes a circumscribing ridge 35 surrounding each of the dye wells. In this embodiment, dye wells 31 are not used. Since the dye will now be placed directly in the wells, in order to prevent intermixture of dye colors, the ridges act as a barrier against any surface splash from the wells falling into an adjacent well. Ridges 35 should generally be about 0.25 inches high.

Also shown in FIG. 7 and designated 39, in the side wall 20S, as well as being present in the dye cup 31 per FIG. 6 when such are employed, though here designated 37, are volume lines. These serve to indicate the amount of fluid in the well or dye cup respectively in the same manner as the lines of a measuring cup. Though only one of such is shown, obviously more can be employed. This volume line, in either utilization, should be established at the level at which an average egg can be inserted all the way into the dye without spilling the dye over the top of the cup or well.

Recesses 27 have a preferably concave wall adapted to conform to the outer surface of an egg. If the egg is super wet after dyeing the large end can be inserted such that only the rim of recess 27 contacts the egg. If the egg is not overly wet, then the narrow end should be set into recess 27 such that the inserted portion of the egg can rest against concave side wall 17 to suitably support the egg during drying and temporary storage.

Figure 8A:
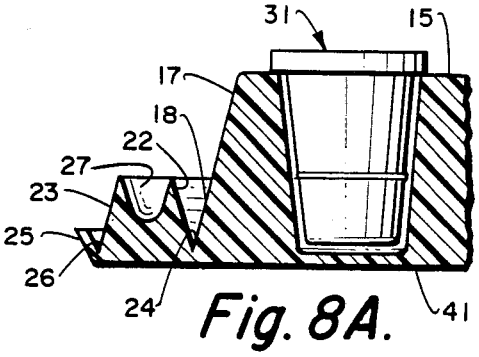
FIGS. 8A and 8B are sectional views similar to that taken along line A—A, for the embodiments of FIGS. 2 and 7.
Figure 8B:
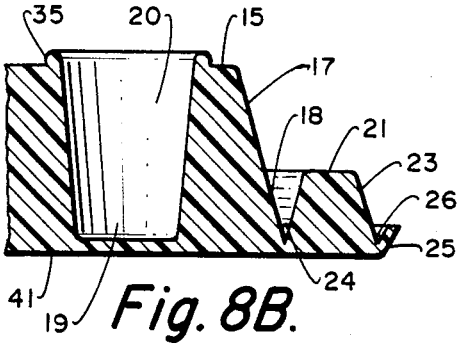

FIGS. 8A and 8B illustrate a manufacturing variation of the embodiments of FIGS. 2 and 7, respectively. Whereas the embodiments previously discussed are either vacuum formed from plastic or drawn from metal, and thus resemble in appearance a typical muffin tin as employed for a microwave over or conventional oven, i.e. the undersurface follows the configuration of the upper surface; the two embodiments of FIG. 8 each include a bottom surface 41. In such instance the device would be made as a solid unit of moulded plastic.

While not shown, it is, of course, within the scope of the invention to attach a flat bottom sheet, not shown, to the underside of the embodiments of FIGS. 2 and 7 as a base to lend stability to the device. Such bottom sheet configured to match, the contour of the structure would be added by sonic welding or adhesing, if both are plastic, or by adhesing or spot welding if the structure 10 and the base are both metal.

Figure 9A:
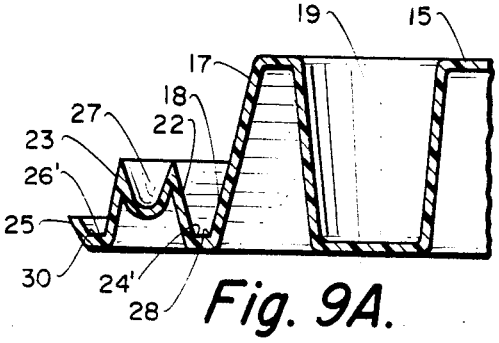
FIGS. 9A and 9B are partial sectional views similar to a view taken along line A—A illustrating a manufacturing variation within the scope of the invention.
Figure 9B:
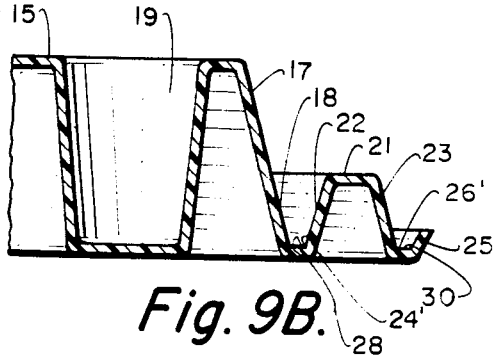

FIGS. 9A and 9B illustrate a variant that can be employed in the construction of the trap 24 and the edge trap 26, which here are designated 24' and 26' respectively. Here the traps are formed not in a V shape by converging side walls, but with the side walls and a horizontal bottom wall designated 28 for the trap and 30 for the edge trap. While perhaps more costly to do so, the volumetric capacity of such a constructed trap and edge trap is greater than those previously discussed.

Figure 11:
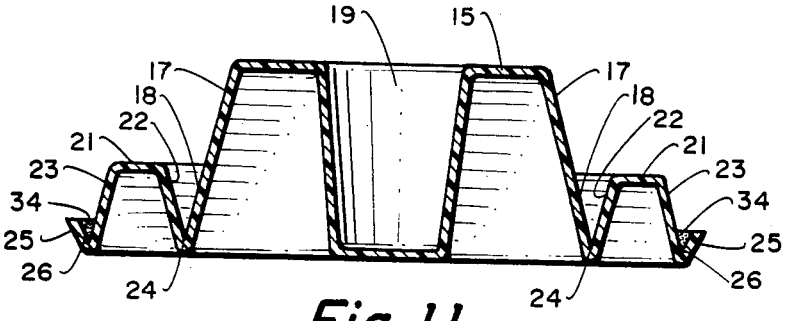
FIG. 11 is a cutaway view of another variant hereof.

FIG. 11 is similar to FIG. 5. Here a filet 34 instead of the edge trap 26 is employed. The rest of the embodiment has been previously discussed. Obviously, ridges 35 may be employed herein too.

It is seen that I have disclosed a unique device for the dyeing and drying and temporary storage of Easter eggs. As mentioned, the device may be made of metal or plastic, filled or hollow, with or without a bottom surface.

Preferably the structure will feature the edge trap as this will serve to keep dye off the table or other surface upon which the device is being used.

While shown in an egg shape configuration, obviously any other shape can be employed. To do so would be within the skill of the art, as all of the features hereof are readily adaptable to any configuration, that permits a plurality of adjacent dye wells on the upper portion's top surface and a plurality of spaced egg receiving smaller diameter troughs or recesses on the lower portion's top surface.

With respect to the dimensions for the device of this invention, it is suggested that each dye well or dye cup be capable of holding up to about 9 oz. of liquid. The diameter of each well should be about 3" while the bottom thereof should be about 2.25 inches. This permits easy insertion of the eggs by little hands. Each egg storing recess should be about 1.125 inches in diameter by about 0.75 inches deep. The overall height may be set at about 4 to 6 inches. These criteria are merely suggestions and should not be deemed to be critical. It is also noted that the embodiments herein all featured 6 dye wells, one for each of the primary colors; red, orange, yellow, green, blue and violet. More or fewer wells and dye cups are also within the scope of the invention.

It is seen that I have provided a device that is almost impossible to tip over, and which incorporates means to contain any small spills of dye such that cleanup after use is minimized.

Since certain changes may be made in the above apparatus without departing from the scope of the invention herein involved, it is intended that all matter contained in the above description and shown in the accompanying drawings shall be interpreted as illustrative and not in a limiting sense.

I claim:

1. An Easter egg dyeing and drying device comprising a one piece rack having an upper portion and a lower portion, the upper portion including a top surface and a circumferentially continuous downwardly depending side wall, a single file of uniformly spaced apart dye wells spaced around the perimeter of the top surface each being directed downwardly from the plurality of locations along the top surface thereof, the lower portion including a top surface, a downwardly depending lower inside wall, and a downwardly depending lower outside wall each of said downwardly depending walls being circumferentially continuous, the bottom edge of the lower inside wall adjoining the bottom of the side wall of the upper portion to form a dye trap, a continuous flange extending upwardly from a bottom edge of said downwardly depending lower outside wall defining an edge trap between the upper portion and the lower portion, the top surface of said lower portion being of a lower elevation than the top surface of the upper portion, a plurality of egg receiving recesses at space intervals in single file, along the top surface of the lower portion, said recesses being of smaller diameter than said wells.

2. The device of claim 1 wherein the device is egg shaped in horizontal cross section.

3. The device of claim 1 wherein the lower portion surrounds the upper portion.

4. The device of claim 3 wherein each dye well further includes indicia indicating volumetric content.

5. The device of claim 3 wherein each dye well is round and includes a circumscribing upstanding lip directed from the top surface of the upper portion.

6. The device of claim 1 including a plurality of dye cups adapted to nest within said dye wells, one (1) cup per well.

7. The device of claim 1 wherein a horizontal surface is interposed between the two vertical adjoining walls forming the dye trap.

8. The device of claim 6 wherein each well and each dye cur are round, and each dye cup includes volumetric indicia.

9. The device of claim 1 including a flat horizontal base beneath said device.

10. The device of claim 1 wherein said device is solid plastic or metal.

11. The device of claim 1 wherein there are almost twice as many egg receiving recesses as dye wells.

* * * * *